US011542148B2

(12) United States Patent
Jackson et al.

(10) Patent No.: US 11,542,148 B2
(45) Date of Patent: Jan. 3, 2023

(54) FREE-STANDING BEVERAGE DISPENSING APPLIANCE AND METHOD FOR OPERATING A BEVERAGE DISPENSING APPLIANCE

(71) Applicant: Haier US Appliance Solutions, Inc., Wilmington, DE (US)

(72) Inventors: Timothy Ray Jackson, Louisville, KY (US); Jordan Andrew Waymeyer, Louisville, KY (US); Brent Alden Junge, Evansville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 80 days.

(21) Appl. No.: 17/197,591

(22) Filed: Mar. 10, 2021

(65) Prior Publication Data

US 2022/0289551 A1 Sep. 15, 2022

(51) Int. Cl.
*B67D 1/08* (2006.01)

(52) U.S. Cl.
CPC ..... *B67D 1/0884* (2013.01); *B67D 1/0888* (2013.01); *B67D 1/0895* (2013.01)

(58) Field of Classification Search
CPC .. B67D 1/0884; B67D 1/0888; B67D 1/0895; G06N 99/005
USPC ..... 222/1, 146.1–146.6, 23, 52, 54
See application file for complete search history.

(56) References Cited

U.S. PATENT DOCUMENTS

| | | | | |
|---|---|---|---|---|
| 8,461,959 | B2 * | 6/2013 | Ebrom | A47L 15/4293 340/3.1 |
| 9,390,381 | B2 * | 7/2016 | Davari | H04L 67/025 |
| 9,638,461 | B2 | 5/2017 | Everette | |
| 10,240,816 | B2 * | 3/2019 | Whitehouse | F24H 1/186 |
| 10,451,294 | B2 | 10/2019 | Barney | |
| 10,928,121 | B1 * | 2/2021 | Robinson | F25D 23/126 |
| 11,287,144 | B2 * | 3/2022 | Porwal | F24D 19/1048 |
| 2012/0223094 | A1 * | 9/2012 | Rickard, Jr. | A23G 9/045 222/30 |
| 2012/0285986 | A1 * | 11/2012 | Irvin | B67D 1/0888 222/30 |
| 2016/0045062 | A1 * | 2/2016 | Howitt | A47J 31/402 222/54 |
| 2020/0024120 | A1 * | 1/2020 | Park | F25D 29/00 |
| 2021/0009401 | A1 * | 1/2021 | Yamashita | B67D 1/0864 |
| 2021/0380392 | A1 * | 12/2021 | Glucksman | B67D 1/0884 |
| 2022/0048754 | A1 * | 2/2022 | Schnacke | B67D 1/1405 |
| 2022/0221212 | A1 * | 7/2022 | Carr | F25C 5/22 |

FOREIGN PATENT DOCUMENTS

| | | | |
|---|---|---|---|
| CN | 103750745 | A | 4/2014 |
| WO | WO2010143835 | A2 | 12/2010 |

* cited by examiner

*Primary Examiner* — Lien M Ngo
(74) *Attorney, Agent, or Firm* — Dority & Manning, P.A.

(57) ABSTRACT

A liquid supply device includes a tank, an electric heating element, a dispenser to dispense liquid from the tank, and a controller configured to initiate a user-responsive heating operation. The user-responsive heating operation includes recording data regarding dispensed liquid amount and temperature, developing an expected heating pattern for the electric heating element, detecting a user, and directing the electric heating element accordingly.

20 Claims, 5 Drawing Sheets

FREE-STANDING BEVERAGE DISPENSING APPLIANCE AND METHOD FOR OPERATING A BEVERAGE DISPENSING APPLIANCE

FIELD OF THE INVENTION

The present subject matter relates generally to liquid supply devices, and more particularly to methods for anticipating heating and dispense patterns of potable water supply devices.

BACKGROUND OF THE INVENTION

In home, restaurant, and office settings, it is common for multiple individual users to enjoy a wide variety of beverages. Such beverages may be hot or cold, flat or carbonated, flavored or unflavored, etc. For instance, coffee, tea, soft-drinks, vitamin/electrolyte drinks, purified chilled water, or hot water may all be desirable at various points in time. Currently, each type of beverage must be obtained from a different machine. At most, existing appliances permit one or two similar beverages (e.g., coffee and tea) to be generated at the same machine. Moreover, typical existing appliances must be hard plumbed such that water is supplied from a connected water source, such as a municipal water system or well.

Such existing appliances present a number of drawbacks. For one, a user may request hot or heated liquid at scheduled, habitual times. Existing appliances require a period of time to heat the liquid to the desired temperature before dispensing, causing a user to have to wait before consuming a desired heated beverage. For another, some existing appliances maintain liquid at a heated temperature. However, this may increase operating costs and waste energy. Moreover, multiple users may request liquid at different temperatures. Accordingly, when the liquid is stored at a first temperature, another user would have to wait for the liquid to reach a second temperature.

As a result, it would be useful to provide an appliance having features for addressing one or more of the above-mentioned issues. In particular, it may be advantageous to provide an improved appliance for predicting desired temperatures or preheating liquid for improved dispensing.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a liquid supply device is provided. The liquid supply device may include a tank in which liquid is stored; an electric heating element connected to the tank to heat the liquid in the tank; a dispenser connected to the tank that selectively dispenses the liquid from the tank; a temperature sensor provided within the liquid supply device and configured to sense a temperature of the liquid; and a controller in communication with the temperature sensor and the electric heating element, the controller configured to initiate a user-responsive heating operation. The user-responsive heating operation may include recording data regarding dispensed liquid temperature from the dispenser over a period of time, developing an expected heating pattern for activation of the electric heating element based on the recorded data, detecting a user presence within the vicinity of the liquid supply device, and directing the electric heating element according to the heating pattern based on detecting the user presence.

In another exemplary embodiment of the present disclosure, a method of operating a liquid supply device is provided. The liquid supply device may include a tank, an electric heating element connected to the tank, a dispenser connected to the tank, and a temperature sensor provided in the liquid supply device. The method may include recording data regarding dispensed liquid temperature from the dispenser over a period of time, developing an expected heating pattern for activation of the electric heating element based on the recorded data, detecting a user presence within the vicinity of the liquid supply device, and directing the electric heating element according to the expected heating pattern based on detecting the user presence.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
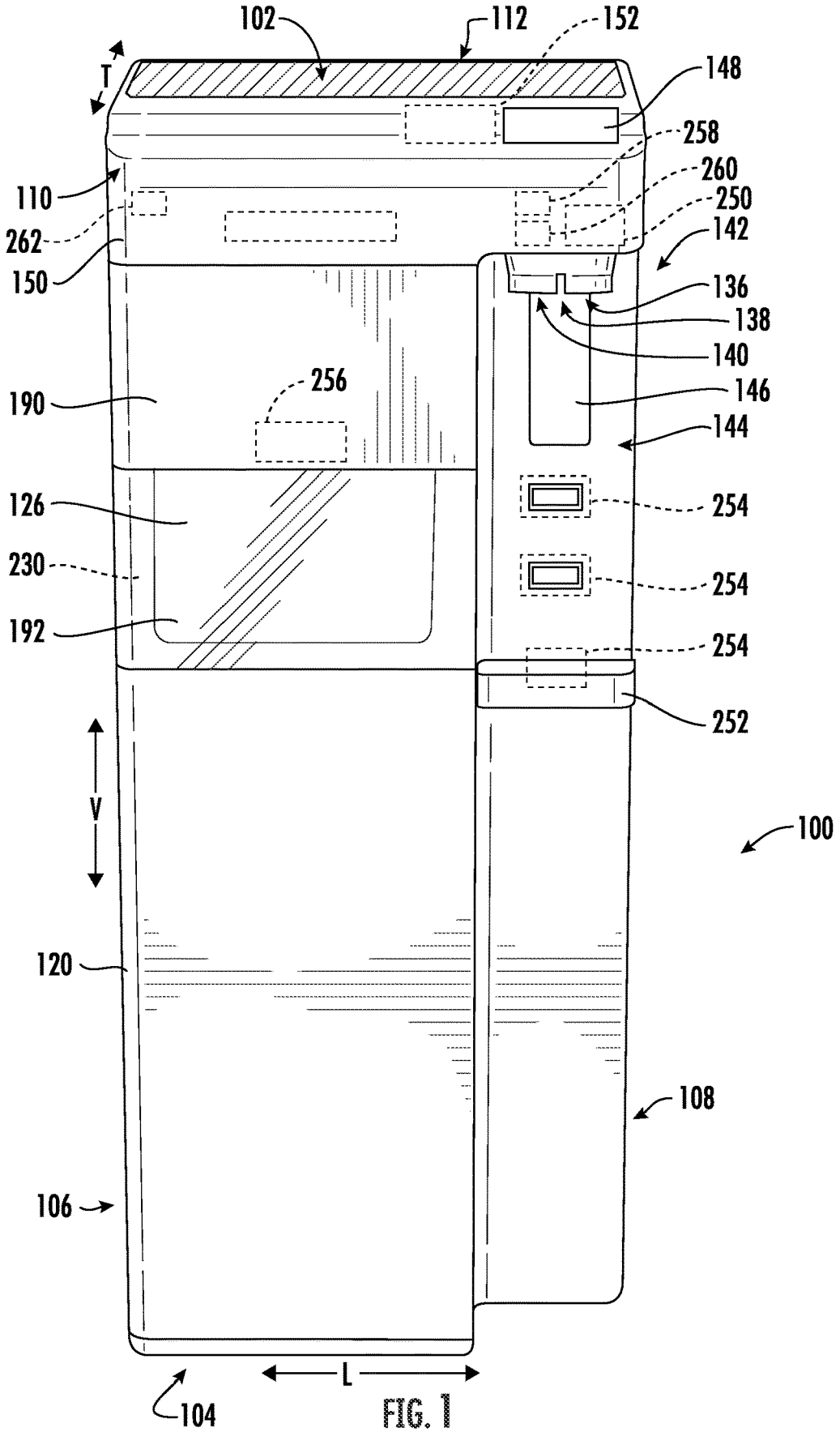
FIG. 1 provides a front perspective view of a free-standing appliance according to exemplary embodiments of the present disclosure.
Figure 2:
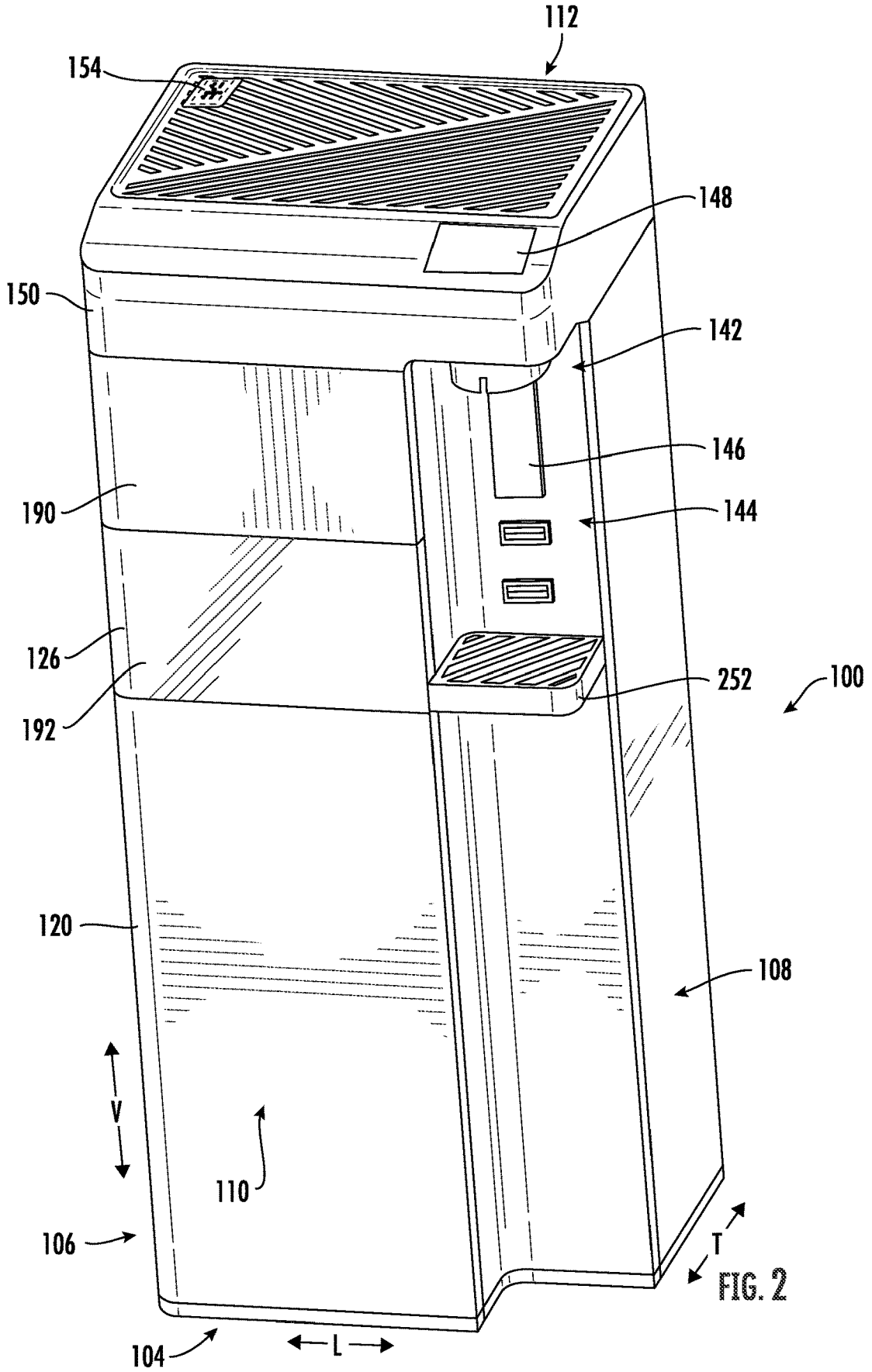
FIG. 2 provides a side perspective view of the exemplary free-standing appliance of FIG. 1.
Figure 3:
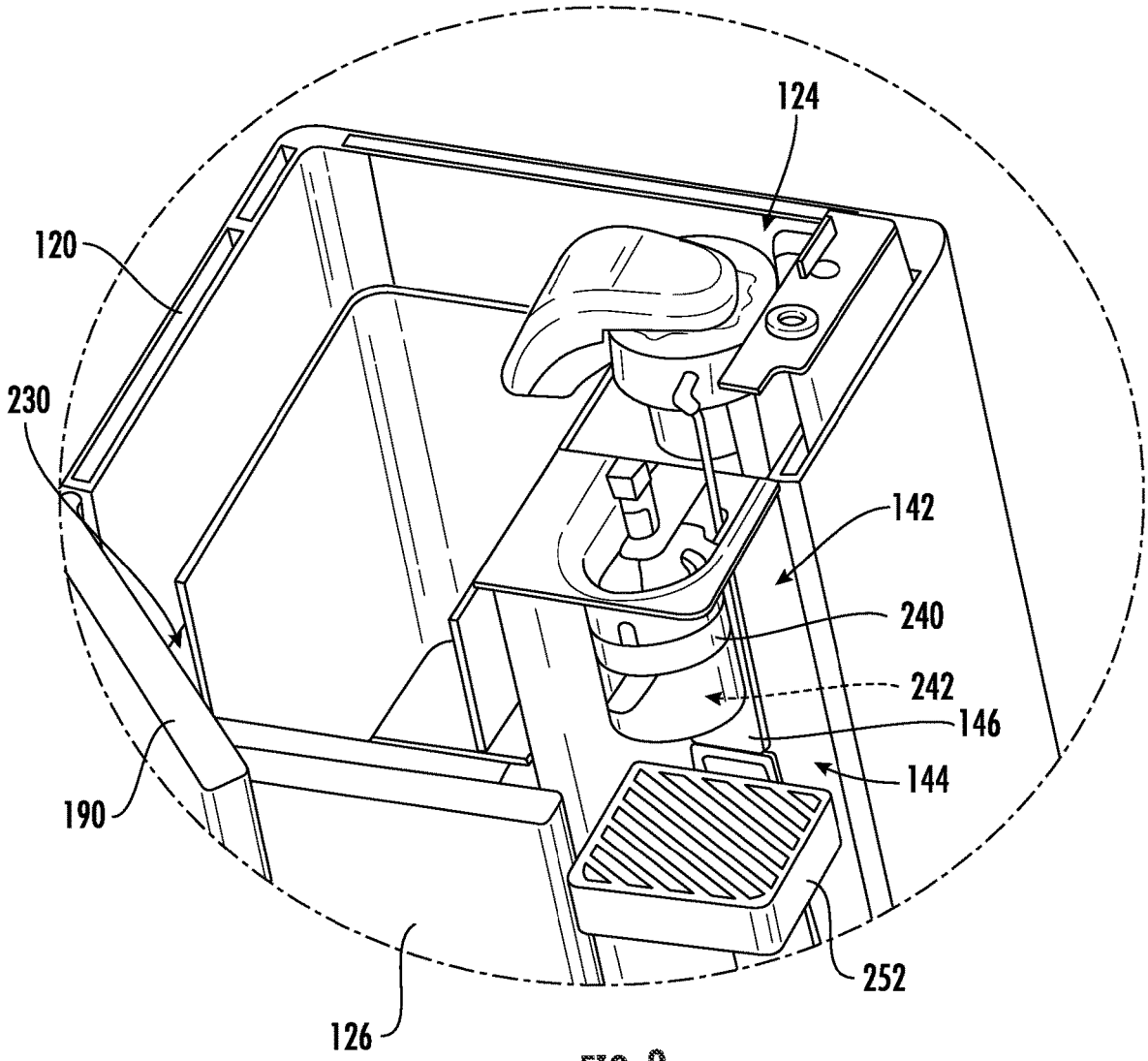
FIG. 3 provides a side perspective view of a top portion of the exemplary free-standing appliance of FIG. 2, wherein a top panel has been removed for the purposes of clarity.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Turning now to the figures, FIGS. 1 through 4 provide various views of a free-standing appliance 100, including certain portions thereof. Generally, free-standing appliance 100 includes a cabinet or housing 120 that extends between a top 102 and a bottom 104 along a vertical direction V; between a first side 106 and a second side 108 along a lateral direction L; and between a front 110 and a back 112 along a transverse direction T. Each of the vertical direction V, lateral direction L, and transverse direction T are mutually perpendicular and thus form an orthogonal direction system. Free-standing appliance 100 may be referred to as a liquid supply device 100.

As will be described in greater detail below, cabinet 120 supports or houses various components of free-standing appliance 100 to produce ice or dispense one more liquids (e.g., beverages) using a water source, such as a refillable internal water tank 122 (e.g., removably held within cabinet 120). For instance, an icemaker 124 may be mounted within cabinet 120 downstream from water tank 122 to receive water therefrom and form ice, which may supplied to a downstream ice bin 126 disposed within the cabinet 120. Additionally or alternatively, one or more water lines (e.g., a cold water line 130, a hot water line 132, or a carbonated water line 134) may be mounted to (e.g., within) cabinet 120 downstream from water tank 122 to selectively dispense liquid(s) from one or more corresponding outlets. A bin door 190 may be movably (e.g., rotatably or slidably) mounted on cabinet 120 to selectively permit access to the bin volume of ice bin 126 through a bin opening. In the illustrated embodiments, bin door 190 is rotatably mounted to cabinet 120 above ice bin 126. Specifically, bin door 190 is disposed above the bin opening such that a user may selectively open bin door 190 and reach down to access ice within ice bin 126 through the bin opening.

Free-standing appliance 100 includes a delivery assembly 142 for delivering or dispensing one or more liquids (e.g., from cold water outlet 136, hot water outlet 138, or carbonated water outlet 140). In some embodiments, a dispenser recess 144 is defined below one or more of the outlets 136, 138, 140. Additionally or alternatively, an actuating mechanism 146, shown as a paddle, may be mounted below the outlet(s) 136, 138, 140 (e.g., within dispenser recess 144) for operating delivery assembly 142. In alternative exemplary embodiments, any suitable actuating mechanism 146 may be used to operate delivery assembly 142. For example, delivery assembly 142 can include a sensor (such as an ultrasonic sensor) or a button rather than the paddle. In certain embodiments, a control panel 148 is provided (e.g., mounted to a top panel 150 of cabinet 120) for controlling the mode of operation. For example, control panel 148 may include a plurality of user inputs (not labeled), such as one or more buttons, knobs, or graphical user interfaces (e.g., presented on a touchscreen display) for selecting a desired mode of operation or beverage to be dispensed.

Operation of the free-standing appliance 100 can be regulated by a controller 152 that is operatively coupled to control panel 148 or various other components, as will be described below. Generally, in response to user manipulation of control panel 148 or one or more sensor signals, controller 152 may operate various components of the free-standing appliance 100. Controller 152 may include a memory and one or more microprocessors, CPUs or the like, such as general or special purpose microprocessors operable to execute programming instructions or micro-control code associated with operation of free-standing appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 152 may be constructed without using a microprocessor (e.g., using a combination of discrete analog or digital logic circuitry; such as switches, amplifiers, integrators, comparators, flip-flops, AND gates, and the like) to perform control functionality instead of relying upon software.

Controller 152 may be positioned in a variety of locations throughout free-standing appliance 100. In the illustrated embodiments, controller 152 is located within top panel 150. In other embodiments, the controller 152 may be positioned at any suitable location within cabinet 120. Input/output ("I/O") signals may be routed between controller 152 and various operational components of free-standing appliance 100. For example, control panel 148 and delivery assembly 142 may be in communication with controller 152 via one or more signal lines or shared communication busses. Additionally or alternatively, controller 152 may be in communication with various other components of free-standing appliance 100. For example, various valves, switches, light sources, etc. may be actuatable based on commands from the controller 152. As discussed, control panel 148 may additionally be in communication with the controller 152. Thus, the various operations may occur based on user input or automatically through controller 152 instruction.

In optional embodiments, a power receptacle 154 having one or more electrical outlet plugs (e.g., standard 3-prong outlets) may be mounted to cabinet 120 (e.g., at top panel 150). An electrical device, such as a coffee grinder or phone charger, having a mating inlet plug may selectively connect and disconnect from power receptacle 154.

Although free-standing appliance 100 is not limited to any specific shape or dimensions, free-standing appliance 100 may generally be sized to fit within a fairly small room, such as an office breakroom, commercial kitchen, or in place of a so-called water cooler (i.e., fountain). Optionally, one or more casters or rollers may be mounted to cabinet 120 (e.g., at the bottom 104) to support free-standing appliance 100 while permitting movement of the same.

Figure 4:
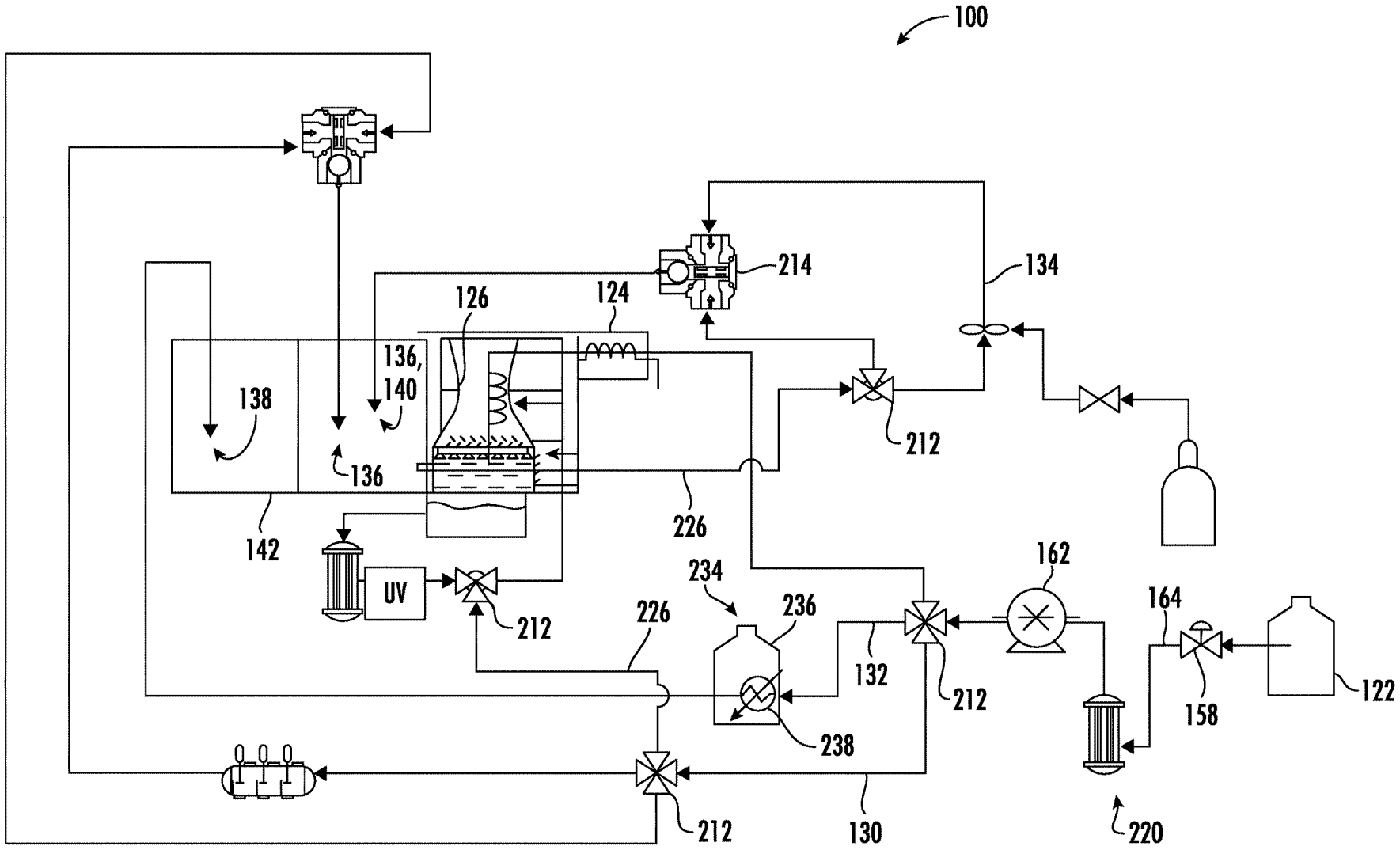
FIG. 4 provides a schematic view of the exemplary free-standing appliance of FIG. 1 illustrating the flow paths of fluids within the free-standing appliance.

Turning especially now to FIG. 4, in addition to cold water line 130, one or more hot water lines 132 may be provided within cabinet 120. For instance, from primary line 164, hot water line 132 may extend to one or more hot water outlets 138 disposed at delivery assembly 142. As shown, although hot water line 132 and cold water line 130 may both be downstream from water tank 122, hot water outlet 138 may be in fluid isolation from each cold water outlet 136. Water flow from water tank 122 to hot water line 132 may be directed by one or more valves 158, 212 or pump 162.

Generally, a heating element or heater 234 is provided along the hot water line 132 to selectively heat water upstream from hot water outlet 138. In some embodiments, a heater tank 236 is disposed within cabinet 120 upstream from hot water outlet 138 (e.g., along hot water line 132). Heater tank 236 may generally define an enlarged volume that is less than that of water tank 122. Thus, a suitable volume of hot water may be held or maintained within heater tank 236. In some embodiments, heater 234 is provided as or includes an electric heater element 238 (e.g., resistive heating wire, resistive thermal element, such as a CALROD®, an inductive heating element, etc.) mounted within heater tank 236 (e.g., to selectively heat the water therein). During use, electric heater element 238 may thus be selectively activated (e.g., by controller 152) to generate or maintain a volume of water between, for instance, 160° Fahrenheit and 210° Fahrenheit.

In some embodiments, a brew module 240 is provided to aid in the generation or dispensing of one or more hot beverages. For instance, brew module 240 may define a brew chamber 242 in which a brew pod (e.g., sealed, disposable cup, or reusable mesh cup) may be received downstream from hot water outlet 138. In some embodiments, brew module 240 is mountable within dispenser recess 144 such that brew module 240 can be in fluid communication with hot water outlet 138 when mounted within dispenser recess 144. For example, when brew module 240 is installed on delivery assembly 142, an inlet of the brew module 240 may receive a water delivery tube to receive heated water therethrough. During use, heated water from the heater tank 236 may thus flow into the brew chamber 242. Within brew module 240, heated water may mix with, dissolve, or extract portions of a particulate material (e.g., held in a brew pod) to form a liquid beverage (e.g., a liquid coffee or tea solution), which may then exit brew module 240 through an outlet defined through brew module 240.

Turning back to FIG. 1, free-standing appliance 100 may further include a liquid level sensor 250 to detect a level of liquid within a cup or container below cold water outlet 136, hot water outlet 138, or carbonated water outlet 140. In some embodiments, liquid level sensor 250 is mounted above the dispenser recess 144 to detect a height of liquid dispensed to a container from the cold water outlet 136. For instance, liquid level sensor 250 may be in communication with controller 152 and operable to measure the height of a liquid within the corresponding container. In exemplary embodiments, liquid level sensor 250 can be any suitable device for detecting or measuring distance to an object. For example, liquid level sensor 250 may be an ultrasonic sensor, an infrared sensor, or a laser range sensor. Controller 152 can receive a signal, such as a voltage or a current, from liquid level sensor 250 that corresponds to the detected presence of or distance to a liquid within the corresponding container. Based on the received signal, controller 152 can initiate or direct an auto-fill sequence. Specifically, controller 152 can determine the height of dispensed liquids within a corresponding container to ensure a predetermined level or dispensed volume is provided to the corresponding container.

In optional embodiments, liquid level sensor 250 can work in tandem with one or more other sensors to control the auto-fill sequence. As an example, in certain embodiments, a movable container tray 252 is provided to support a container below delivery assembly 142. Movable container tray 252 may be selectively mounted to cabinet 120 at a plurality of predetermined discrete heights along the vertical direction V. For instance, each discrete height may provide or define a separate receiving index (e.g., post, recess, clip, etc.) on which movable container tray 252 may be mounted. At each discrete height a separate fixed tray sensor 254 (e.g., reed switch, Hall effect sensor, pressor sensor, etc.) may be provided to detect the presence of movable container tray 252. In some such embodiments, controller 152 may be configured to receive a signal from the fixed tray sensor 254 at which movable container tray 252 is mounted, and further direct the auto-fill sequence based on the same. For instance, controller 152 may the use the tray sensor signal to detect a distance between the movable container tray 252 and the liquid level sensor 250, and thus estimate a base height of the container that is to be filled.

Additionally or alternatively, delivery assembly (or dispenser) 142 may include one or more sensors for sensing various attributes related to dispensed liquid. For instance, dispenser 142 may include a flow meter 258. The flow meter 258 may be configured to measure an amount of liquid dispensed from the dispenser. In detail, the flow meter 258 may sense a volume of liquid dispensed at each dispensation and send the resultant measurements to controller 152. Controller 152 may store the measurements in a table, for example, a look-up table. Moreover, controller 152 may date stamp each measurement sent by flow meter 258 (e.g., a time of day, day of the week, etc.). Accordingly, controller 152 may tabulate information relating to amounts of liquid dispensed at particular times.

Additionally or alternatively, dispenser 142 may include a temperature sensor 260 (e.g., thermistor, thermocouple, etc.). Temperature sensor 260 may sense or measure a temperature of liquid (e.g., heated liquid) that is dispensed at each dispensation. Temperature sensor 260 may work in tandem with flow meter 258. In detail, flow meter 258 and temperature sensor 260 may send sensed measurements together to controller 152. Controller 152 may store the measurements in a table, for example, a look-up table. Moreover, controller 152 may date stamp each measurement sent by temperature sensor 260 (e.g., a time of day, day of the week, etc.). Accordingly, controller 152 may tabulate information relating to temperatures of liquid dispensed at particular times.

As an additional or alternative example, one or more sensors may be provided to selectively halt or prevent an auto-fill sequence from proceeding. In some such embodiments, a door sensor 256 is mounted to cabinet 120 in selectively engagement with door. For instance, door sensor 256 may generally detect when bin door 190 is moved away from the closed position and transmit/halt a signal to controller 152 in response to the same. To that end, door sensor 256 may include any suitable physical detection sensor (e.g., reed switch, Hall effect sensor, pressor sensor, etc.) to selectively engage with bin door 190 in the closed position. In response to placement of the bin door 190 away from the closed position, door sensor 256 may thus transmit a door ajar signal to the controller 152. In response to receiving the door ajar signal, the controller 152 is may halt or prevent the auto-fill sequence.

Free-standing appliance 100 may further include a proximity sensor 262. Proximity sensor 262 may be configured to sense a user's presence within a certain distance from free-standing appliance 100. For example, proximity sensor 262 may emit an electromagnetic field across a predetermined area. The type of electromagnetic field (or electromagnetic radiation, for example, infrared) may vary according to applications, and the disclosure is not limited to those listed herein. Upon sensing changes in the electromagnetic field, proximity sensor 262 may detect the presence of a user. Proximity sensor 262 may then transmit the proximity signal to controller 152. Controller 152 may then use the proximity signal to activate various features of appliance 100 (e.g., electric heater element 238, icemaker 124, etc.).

Advantageously, free-standing appliance 100 supply and dispense multiple types of beverages within a relatively small or unplumbed assembly. Additionally or alternatively, one or more beverage may be efficiently generated or supplied within close proximity to generated ice (e.g., without requiring a full refrigerator appliance).

Figure 5:
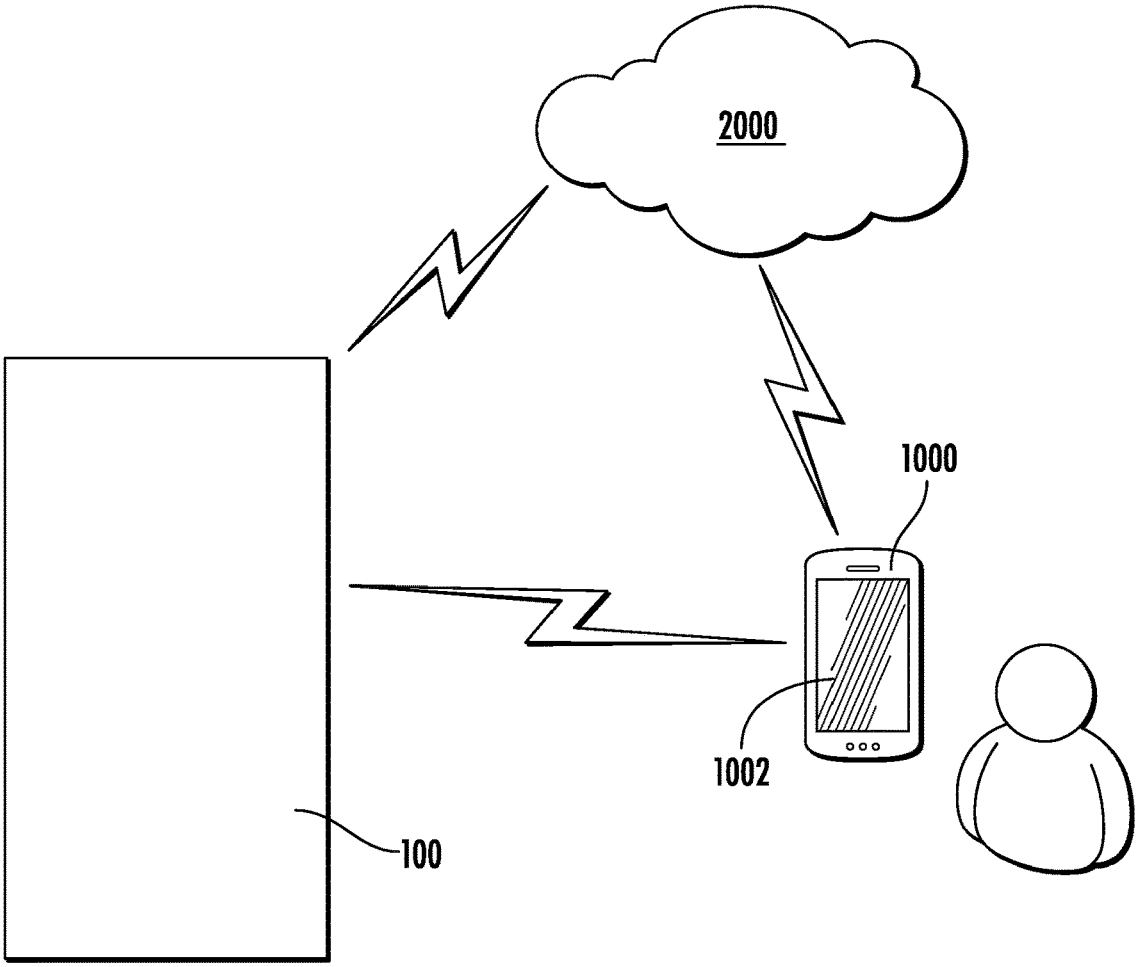
FIG. 5 provides a schematic illustration of an exemplary free-standing appliance in communication with a remote user interface device according to one or more embodiments of the present disclosure.

FIG. 5 schematically illustrates the free-standing appliance 100 communicating with a remote user interface device 1000. Also shown (but not numbered) in FIG. 5 is a user such as may interact with the remote user interface device 1000, e.g., via a user interface 1002 of the remote user interface such as a touchscreen in the illustrated embodiment. For example, the remote user interface device 1000 may be a hand-held device, such as a cell phone or smart phone or any similar device, in operative communication with the controller 152 via a wireless connection. As shown in FIG. 5, the free-standing appliance 100, and in particular, controller 152 thereof, may be configured to communicate with a separate device external to the appliance 100, such as a communications device or other remote user interface device 1000. The remote user interface device 1000 may be a laptop computer, smartphone, tablet, personal computer, wearable device, smart home system, or various other suitable devices. The free-standing appliance 100 may include a network communication module, e.g., a wireless communication module, for communicating with the remote user interface device 1000. In various embodiments, a network communication module may include a network interface such that the controller 152 of the free-standing appliance 100 can connect to and communicate over one or more networks with one or more network nodes. A network communication module may also include one or more transmitting, receiving, or transceiving components for transmitting/receiving communications with other devices communicatively coupled with free-standing appliance 100. The network communication module may be in communication with, e.g., coupled or connected to, the controller 152 to transmit signals to and receive signals from the controller 152.

As schematically illustrated in FIG. 5, the free-standing appliance 100 may be configured to communicate with the remote user interface device 1000 either directly or through a network 2000 (e.g., a smart home network). Thus, in various embodiments, the free-standing appliance 100 and the remote user interface 1000 may be configured to communicate wirelessly with each other or with the network 2000. The network 2000 may be or include various possible communication connections and interfaces, e.g., such as Zigbee, BLUETOOTH®, WI-FI®, or any other suitable communication connection. The remote user interface device 1000 may include a memory for storing and retrieving programming instructions. For example, the remote user interface device 1000 may be a smartphone operable to store and run applications, also known as "apps," and may include a remote user interface provided as a smartphone app. Additionally or alternatively, the network 2000 may recognize and register the presence of a user by recognizing the presence of a particular remote user interface device 1000. In some embodiments, the network 2000 may recognize certain features of the particular remote user interface device 1000, such as an alarm setting time for instance.

Figure 6:
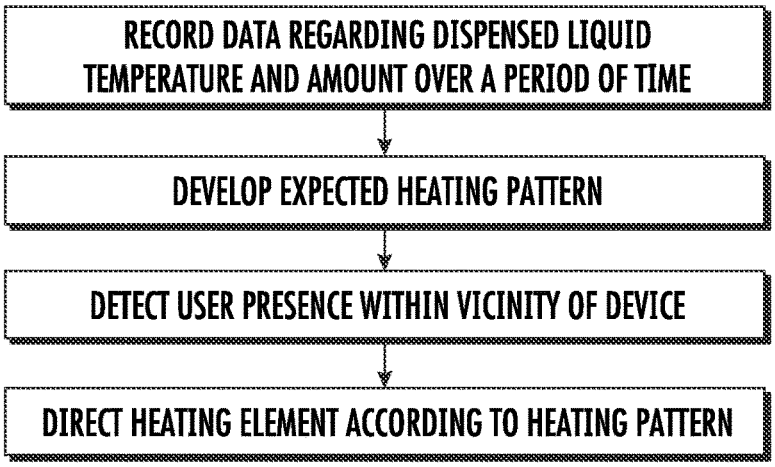
FIG. 6 provides a flow chart illustrating a method of operating a free-standing appliance.

Turning now to FIG. 6, a method 400 of operating a free-standing appliance will be discussed in detail. Method 400 may be applied to any suitable free-standing beverage dispense device (e.g., appliance 100), particularly a free-standing appliance that is able to dispense hot or heated water. For instance, method 400 may be fine tuned over time according to data recorded and analyzed by the appliance.

At step 402, method 400 may include recording data regarding a dispensed liquid temperature and a dispensed liquid amount from a dispenser over a period of time. The period of time may be variable (i.e., the data may be continuously recorded throughout an operation). Thus, a developed heating pattern may be continuously modified and adapted as more data is recorded and analyzed. In detail, a flow meter provided at the dispenser may regularly record when liquid is dispensed. The flow meter may then send this information to a controller to be analyzed or stored. For example, the flow meter may record or sense an amount (e.g., volume) of liquid dispensed at each dispensation. In addition, the flow meter or the controller may attach a time stamp to the recorded amount (e.g., a time of day, day of the week, etc.). The controller may continually store or analyze each dispensation sensed by the flow meter. For example, an initiation of the dispensation may be defined by an opening of the dispenser to allow liquid to flow out of the dispenser, and a completion of the dispensation may be defined by a closing of the dispenser to halt the flow of liquid out of the dispenser. Accordingly, a "dispensation" may be defined as the time between the opening and closing of the dispenser.

A temperature sensor may also be provided within the appliance. The temperature sensor may be located at the dispenser. In some embodiments, the temperature sensor is attached to a tank (e.g., tank 122) in which the liquid is stored. When the flow meter senses a dispensation, the temperature sensor may sense the temperature at which the liquid is dispensed and send the recorded temperature to the controller. The controller may then analyze the sensed temperature together with the sensed amount at dispensation and record the results (i.e., in a table format). Additionally or alternatively, the controller may determine a temperature of each dispensation according to a temperature input by a user to the appliance, for example, by the control panel or a remote device. The controller may continually tabulate the sensed amounts and sensed temperatures of each dispensation and record the results.

At step 404, method 400 may include developing an expected heating pattern for activation of the heater based on the recorded dispensing data. The controller may routinely (e.g., according to a defined interval or schedule) analyze the data sensed at one or more dispensations regarding amount of liquid and temperature of liquid at specific times. As a result, the controller may begin to predict when a particular user may request a specific amount of water at a particular temperature. Accordingly, the controller may develop the expected heating pattern based on the data previously recorded. For example, if a user requests ten ounces of water at 160° F. at 9:00 AM on multiple (e.g., three or more) successive or uninterrupted days, the controller may develop an expected heating pattern such that a heater (e.g., electric heater element 238) is activated each morning before 9:00 AM to allow sufficient time to have the liquid available at 160° F. at 9:00 AM.

The controller may develop more complex expected heating patterns as well. For instance, the expected heating patterns may consider multiple users, different amounts (e.g., volumes) at different times, different temperatures at different times, and semi-regular dispensations (e.g., only Monday through Friday, for example). Additionally or alternatively, the expected heating patterns may consider user interface interaction (i.e., when a user or users are physically interacting with the dispenser), motion sensing to detect a presence or proximity of an individual user, smart home or network inputs such as location detection (i.e., having a home network detect that an individual's mobile device is also connected to the home network or WiFi network), or pre-programmed schedules input by one or more users. Thus, the controller may develop one or more expected heating patterns according to data recorded via the flow meter and the temperature sensor. Additionally or alternatively, the controller may alter the expected heating patterns based on new data. For instance, if over the period of one week, the flow meter begins sensing a dispensation at 10:00 AM over multiple successive or uninterrupted days, the controller may alter the expected heating pattern to provide the desired temperature and amount of water at 10:00 AM. Thus, the expected heating pattern may be a planned heating pattern according to anticipated requests for hot or heated water. As such, the expected heating pattern may differ from an actual heating pattern. For instance, if a user requests a certain volume of liquid at a certain temperature that is outside of the expected heating pattern, the controller may activate the electric heating element to heat the water at the instant of request.

The expected heating pattern may include holding the selected or requested temperature for a predetermined amount of time. For instance, returning to the example above, the controller may control the electric heating element to heat the liquid in the appliance to 160° Fahrenheit before the requested dispense time (e.g., a set period prior to the requested dispense time). The controller may further control the electric heating element to remain active for the predetermined amount of time. Additionally or alternatively, the controller may control the electric heating element to turn off after the liquid has been dispensed or after the predetermined amount of time has elapsed, whichever occurs first. The predetermined amount of time may be between ten minutes and forty minutes. In one example, the predetermined amount of time is thirty minutes. Thus, when the predetermined amount of time elapses before liquid is dispensed, the controller may deactivate the electric heating element, thus saving energy and reducing operating costs for the appliance. Accordingly, the expected heating pattern may be referred to as an expected temperature pattern.

The controller may develop and display (e.g., on a display of the appliance or a remote device) a graph indicating the expected heating pattern. For example, upon determining the expected heating pattern, the controller instructs the display to display the expected heating pattern in a graphical format (e.g., time vs. temperature). Accordingly, the user may visually interpret the expected heating pattern and, in some instances, visualize the beverages which are commonly consumed at specific times of the day. Advantageously, the user may then fine tune the expected heating pattern or adjust their consumption habits accordingly (e.g., for health reasons or energy saving reasons).

At step 406, method 400 may include detecting a user's presence within the vicinity of the appliance or device. As mentioned previously, the appliance may include a proximity sensor configured to sense the proximity of a user, for example, by detecting movement. The proximity sensor may sense a movement of a user in the vicinity of the appliance and send the resulting data to the controller. In this instance, the term "vicinity" may refer to a predetermined distance or location with respect to the appliance. For example, the predetermined distance or location may be within 10 feet of the appliance. In some embodiments, the predetermined distance may be within twenty feet of the appliance. In some embodiments, application or initiation of the expected pattern may be contingent on detecting a user's presence. For instance, in response to detecting a user's presence, the controller may look up a stored heating pattern (e.g., from a look-up table). Such contingencies will be explained in greater detail below.

Additionally or alternatively, the appliance may be connected to a wireless network. In detail, the appliance may communicate with remote devices (e.g., mobile phones, wireless routers, etc.). In some embodiments, the appliance determines the presence of a user by recognizing that a particular mobile device is connected to the same network as the appliance itself. In this regard, the appliance may be able to discern between individual users who may have different preferences and operate the electric heating element accordingly. For instance, a first user may typically request a certain volume of liquid at a first temperature, while a second user may typically request a certain volume of liquid at a second temperature different from the first temperature. By distinguishing which user is present, the controller may control the electric heating element according to the present user's typical requests.

Further additionally or alternatively, the appliance may deactivate the electric heating element entirely when no user is detected for a predetermined length of time. For instance, if the proximity sensor is not activated for 2 days, the controller may determine that the appliance is unlikely to be used and deactivate the electric heating element. Additionally or alternatively, the controller may determine that no remote device is connected to the wireless network for the predetermined length of time. For instance, if no remote device is detected for 2 days, the controller may determine that the appliance is unlikely to be used and deactivate the electric heating element. Accordingly and advantageously, the controller may determine scenarios in which a user or users are unlikely to use the appliance for an extended period of time (e.g., vacation) and deactivate the electric heating element accordingly, saving energy and reducing operating costs.

At step 408, method 400 may include directing the electric heating element according to the heating pattern based on detecting the user's presence. As described previously, the controller may determine one or more expected heating patterns according to the data collected by the flow meter and the temperature sensor. When a user's presence is detected in the vicinity of the appliance, the controller may activate the heating element and implement the developed expected heating pattern. The expected heating pattern may differ according to individual users. For instance, a first user may have a first expected heating pattern while a second user may have a second expected heating pattern. In some embodiments, the first expected heating pattern and the second expected heating pattern are combined into a joint expected heating pattern. For instance, the first user may request a first volume of liquid at a first temperature at a first time of day. Additionally, the second user may request a second volume of liquid at a second temperature at a second time of day. Accordingly, the controller may combine the first and second expected heating patterns to accommodate each of the first and second user. It should be understood that the joint expected heating pattern may include any number of users and any number of expected heating patterns.

In some embodiments, the appliance may include a motion heating feature. In this instance, the controller may be programmed to activate the electric heating element to heat the liquid in the appliance upon detecting motion in the vicinity of the appliance. For instance, a user may preselect a specific temperature to which the liquid should be heated. accordingly, when the proximity sensor detects motion in the vicinity of the appliance, the controller activates the electric heating element to heat the liquid to the preselected temperature. Accordingly, the appliance may be primed to provide hot or heated water at a desired time based on the presence of a user.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A liquid supply device, comprising:

a tank in which liquid is stored;

an electric heating element connected to the tank to heat the liquid in the tank;

a dispenser connected to the tank that selectively dispenses the liquid from the tank;

a temperature sensor provided within the liquid supply device and configured to sense a temperature of the liquid; and a controller in communication with the temperature sensor and the electric heating element, the controller configured to initiate a user-responsive heating operation, the user-responsive heating operation comprising recording data regarding dispensed liquid temperature from the dispenser over a period of time, developing an expected heating pattern for activation of the electric heating element based on the recorded data, detecting a user presence within the vicinity of the liquid supply device, and directing the electric heating element according to the heating pattern based on detecting the user presence.

2. The liquid supply device of claim 1, wherein developing the expected heating pattern comprises:

determining a number of activation instances for the dispenser over the period of time; and establishing a dispenser-activation schedule based on the number of activation instances.

3. The liquid supply device of claim 1, further comprising a proximity sensor attached to the liquid supply device and in communication with the controller, the proximity sensor configured to transmit a proximity signal to the controller.

4. The liquid supply device of claim 3, wherein the user-responsive heating operation further comprises:

detecting a user within a detectable range relative to the liquid supply device via the proximity sensor; and activating the electric heating element to heat the liquid in the tank to a predetermined temperature in response to detecting the user is within the detectable range.

5. The liquid supply device of claim 3, wherein the expected heating pattern comprises:

determining that a motion heating feature has been enabled;

detecting motion in the vicinity of the liquid supply device via the proximity sensor; and activating the electric heating element to heat the liquid in the tank to a predetermined temperature in response to detecting the motion in the vicinity of the liquid supply device.

6. The liquid supply device of claim 1, further comprising a flow meter provided at the dispenser and configured to measure an amount of liquid dispensed from the dispenser, wherein the recorded data further comprises a dispensed liquid amount over the period of time.

7. The liquid supply device of claim 1, wherein the expected heating pattern comprises:

determining that heated liquid has been dispensed from the dispenser within a set time period from a current time of day at least once within seven previous days; and activating the electric heating element to heat the liquid in the tank to a predetermined temperature in response to determining that the heated liquid has been dispensed from the dispenser within fifteen minutes of the current time of day at least once within seven previous days.

8. The liquid supply device of claim 1, wherein the expected heating pattern comprises:

determining, via the flow meter, that heated liquid has been dispensed from the dispenser within fifteen minutes of a current time of day more than once within seven previous days;

determining, via the flow meter, that the heated liquid has been dispensed at a specific temperature at each dispensation; and activating the electric heating element to heat the liquid in the tank to the specific temperature in response to determining that the heated liquid has been dispensed from the dispenser within a set time period from the current time of day more than once within seven previous days.

9. The liquid supply device of claim 1, wherein the controller is further configured to register multiple users and determine an expected heating pattern for each user.

10. The liquid supply device of claim 1, wherein the liquid supply device is connected to a smart home network, and wherein the liquid supply device communicates with one or more mobile devices via the smart home network.

11. A method of operating a liquid supply device, the liquid supply device comprising a tank, an electric heating element connected to the tank, a dispenser connected to the tank, and a temperature sensor provided in the liquid supply device, the method comprising:

recording data regarding dispensed liquid temperature from the dispenser over a period of time, developing an expected heating pattern for activation of the electric heating element based on the recorded data, detecting a user presence within the vicinity of the liquid supply device, and directing the electric heating element according to the expected heating pattern based on detecting the user presence.

12. The method of claim 11, wherein the expected heating pattern comprises:

determining a number of activation instances for the dispenser over the period of time; and establishing a dispenser-activation schedule based on the number of activation instances.

13. The method of claim 11, wherein the liquid supply device further comprises a proximity sensor attached to the liquid supply device and in communication with a controller, the proximity sensor configured to transmit a proximity signal to the controller.

14. The method of claim 13, further comprising:

detecting a user within a detectable range relative to the liquid supply device via the proximity sensor; and activating the electric heating element to heat the liquid in the tank to a predetermined temperature in response to detecting the user is within the detectable range.

15. The method of claim 13, wherein the expected heating pattern comprises:

determining that a motion heating feature has been enabled;

detecting motion in the vicinity of the liquid supply device via the proximity sensor; and activating the electric heating element to heat the liquid in the tank to a predetermined temperature in response to detecting the motion in the vicinity of the liquid supply device.

16. The method of claim 11, wherein the liquid supply device further comprises a flow meter provided at the dispenser, and wherein the recorded data further comprises a dispensed liquid amount.

17. The method of claim 11, wherein the expected heating pattern comprises:

determining that heated liquid has been dispensed from the dispenser within a set time period from a current time of day at least once within seven previous days; and activating the electric heating element to heat the liquid in the tank to a predetermined temperature in response to determining that the heated liquid has been dispensed from the dispenser within fifteen minutes of the current time of day at least once within seven previous days.

18. The method of claim 11, wherein the expected heating pattern comprises:

determining, via the flow meter, that heated liquid has been dispensed from the dispenser within fifteen minutes of a current time of day more than once within seven previous days;

determining, via the flow meter, that the heated liquid has been dispensed at a specific temperature at each dispensation; and activating the electric heating element to heat the liquid in the tank to the specific temperature in response to determining that the heated liquid has been dispensed from the dispenser within a set time period from the current time of day more than once within seven previous days.

19. The method of claim 11, wherein the controller is further configured to register multiple users and determine an expected heating pattern for each user.

20. The method of claim 11, wherein the liquid supply device is connected to a smart home network, and wherein the liquid supply device communicates with one or more mobile devices via the smart home network.

* * * * *